US010025235B2

(12) United States Patent
Tamaki et al.

(10) Patent No.: US 10,025,235 B2
(45) Date of Patent: Jul. 17, 2018

(54) IMAGE FORMING APPARATUS WITH POWER SUPPLIES FOR SECONDARY TRANSFER UNIT

(71) Applicant: Konica Minolta, Inc., Tokyo (JP)

(72) Inventors: Kenji Tamaki, Tokorozawa (JP); Kenji Izumiya, Hachioji (JP); Satoshi Ogata, Hachioji (JP); Hidenori Mine, Tachikawa (JP); Hirokatsu Kodama, Kodaira (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/677,715

(22) Filed: Aug. 15, 2017

(65) Prior Publication Data

US 2018/0059584 A1 Mar. 1, 2018

(30) Foreign Application Priority Data

Aug. 24, 2016 (JP) ..... 2016-163631

(51) Int. Cl.
*G03G 15/16* (2006.01)

(52) U.S. Cl.
CPC ..... *G03G 15/1675* (2013.01)

(58) Field of Classification Search
CPC . G03G 15/1665; G03G 15/1675; G03G 13/16
USPC ..... 399/66
See application file for complete search history.

(56) References Cited

U.S. PATENT DOCUMENTS

| | | | | |
|---|---|---|---|---|
| 8,929,760 | B2 * | 1/2015 | Tanaka | G03G 15/1675 399/101 |
| 9,128,422 | B2 * | 9/2015 | Yashiro | G03G 15/1605 |
| 9,134,656 | B2 * | 9/2015 | Mizutani | G03G 15/1605 |
| 2012/0321332 | A1 * | 12/2012 | Yanagi | G03G 15/1605 399/66 |

FOREIGN PATENT DOCUMENTS

| | | | |
|---|---|---|---|
| JP | 2005010491 | A | 1/2005 |
| JP | 2011007907 | A * | 1/2011 |
| JP | 2014035464 | A * | 2/2014 |
| JP | 2014134616 | A * | 7/2014 |

* cited by examiner

*Primary Examiner* — Robert Beatty
(74) *Attorney, Agent, or Firm* — Lucas & Mercanti, LLP

(57) ABSTRACT

An image forming apparatus includes: an image holder that holds a toner image; a transferer that is disposed opposite to the image holder so as to be in contact with the image holder and transfers the toner image from the image holder onto a recording sheet that is going through a contact part where the transferer contacts the image holder, by applying a transfer voltage between the transferer and the image holder; a first power source that applies a voltage of a first polarity to the image holder; and a second power source that applies a voltage of a second polarity, which is reverse to the first polarity, to the transferer.

6 Claims, 5 Drawing Sheets

FIG.7A
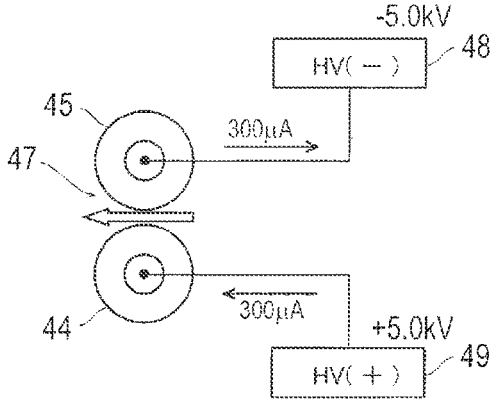
FIG.7B
Prior Art
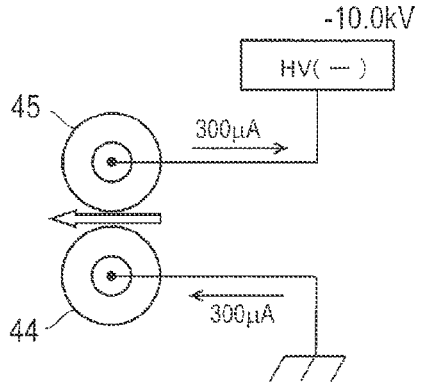
FIG.8
200
| | COVERAGE 200% | | | | | | COVERAGE 0% | | | | | |
|---|---|---|---|---|---|---|---|---|---|---|---|---|
| BASIS WEIGHT (gsm) | FIRST SURFACE | | | SECOND SURFACE | | | FIRST SURFACE | | | SECOND SURFACE | | |
| | LL | NN | HH | LL | NN | HH | LL | NN | HH | LL | NN | HH |
| 81-91 | 540 | 660 | 540 | 540 | 660 | 540 | 270 | 330 | 270 | 270 | 330 | 270 |
| 92-105 | 540 | 660 | 540 | 540 | 660 | 540 | 270 | 330 | 270 | 270 | 330 | 270 |
| 106-135 | 570 | 660 | 540 | 570 | 660 | 540 | 285 | 330 | 270 | 285 | 330 | 270 |
| 136-176 | 600 | 720 | 540 | 600 | 690 | 600 | 300 | 360 | 270 | 300 | 345 | 300 |
| 177-216 | 600 | 720 | 540 | 600 | 720 | 600 | 300 | 360 | 270 | 300 | 360 | 300 |
| 217-256 | 600 | 720 | 600 | 600 | 720 | 660 | 300 | 360 | 300 | 300 | 360 | 330 |
| 257-300 | 600 | 720 | 720 | 660 | 720 | 720 | 300 | 360 | 360 | 330 | 360 | 360 |
| 301-350 | 660 | 720 | 600 | 660 | 720 | 720 | 330 | 360 | 300 | 330 | 360 | 360 |
VOLTAGE VALUE (V)

IMAGE FORMING APPARATUS WITH POWER SUPPLIES FOR SECONDARY TRANSFER UNIT

CROSS-REFERENCE TO RELATED APPLICATION

Japanese Patent Application No. 2016-163631 filed on Aug. 24, 2016, including description, claims, drawings, and abstract the entire disclosure is incorporated herein by reference in its entirety.

BACKGROUND

1. Technological Field

The present invention relates to an image forming apparatus and an image forming method.

2. Description of the Related Art

An image forming apparatus such as an electrophotographic printer forms an image on paper through the processes of charging, exposing, developing, and transferring. In a usual transferring process, the toner image formed on a photosensitive drum is transferred onto an intermediate transfer belt in the primary transfer process and the toner image transferred onto the intermediate transfer belt is in turn transferred to a sheet of paper in the secondary transfer process.

In the secondary transfer process, a transfer voltage is applied between the intermediate transfer belt and a secondary transfer roller, and the toner image is transferred from the intermediate transfer belt to a sheet of paper as the sheet of paper goes through between the intermediate transfer belt and the secondary transfer roller. Inside the intermediate transfer belt, a secondary transfer counter roller is disposed in the opposite position to the secondary transfer roller, and the transfer voltage is applied only to the secondary transfer counter roller, with the secondary transfer roller electrically grounded (for example, see Japanese Unexamined Patent Application Publication No. 2005-010491).

In production printing and other fields, a high productivity is required. To achieve a high productivity, the paper conveyance speed needs to be increased, which entails the need for shortening transfer time by applying a higher transfer voltage in the secondary transfer process.

According to the technique disclosed in Japanese Unexamined Patent Application Publication No. 2005-010491, however, transfer voltage is applied only to the secondary transfer counter roller, which is disadvantageous in that a higher transfer voltage would require a power source with a high voltage transformer and high voltage wiring and hence lead to a cost increase and an increase in the size of the power source. Besides, other requirements would arise such as ensuring insulation distance (clearance distance and creepage distance) and wiring arrangement for avoiding interference with the signal wires and would increase constraints on designing, which is not desirable.

SUMMARY

The present invention has been made in view of the aforementioned disadvantages. Hence, an object of the present invention is to provide an image forming apparatus and an image forming method that allow transfer voltage in the secondary transfer process to be increased while imposing few constraints on designing and limiting a size increase of the power source and a cost increase.

To achieve at least one of the abovementioned objects, according to an aspect of the present invention, an image forming apparatus reflecting one aspect of the present invention includes: an image holder that holds a toner image; a transferer that is disposed opposite to the image holder so as to be in contact with the image holder and transfers the toner image from the image holder onto a recording sheet that is going through a contact part where the transferer contacts the image holder, by applying a transfer voltage between the transferer and the image holder; a first power source that applies a voltage of a first polarity to the image holder; and a second power source that applies a voltage of a second polarity, which is reverse to the first polarity, to the transferer.

To achieve at least one of the abovementioned objects, according to another aspect of the present invention, an image forming method reflecting another aspect of the present invention includes: conveying a recording sheet in a conveyance path; and applying a transfer voltage between an image holder that holds a toner image and a transferer that is disposed opposite to the image holder so as to be in contact with the image holder by applying a voltage of a first polarity supplied by a first power source to the image holder and applying a voltage of a second polarity supplied by a second power source to the transferer, the second polarity being reverse to the first polarity, to transfer the toner image from the image holder onto a recording sheet that is going through a contact part where the transferer contacts the image holder.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

FIG. 7A is a diagram illustrating the secondary transfer unit of the image forming apparatus.

FIG. 7B is a diagram illustrating the secondary transfer unit of a conventional image forming apparatus.

FIG. 8 is a diagram illustrating an example of a voltage value reference table.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
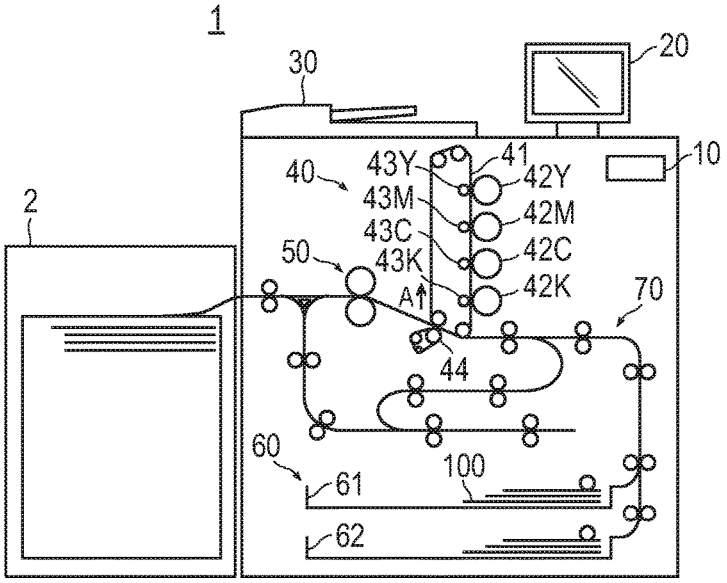
FIG. 1 is a cross sectional view schematically illustrating the configuration of an image forming apparatus according to an embodiment of the present invention.

FIG. 1 is a cross sectional view schematically illustrating the configuration of an image forming apparatus 1 according to an embodiment of the present invention.

As illustrated in FIG. 1, the image forming apparatus 1 includes a controller 10, an operation panel 20, an image reader 30, an image former 40, a fixer 50, a paper feeder 60, and a paper conveyer 70. The image forming apparatus 1 is connected with a stacker apparatus 2, which stacks sheets of paper 100 ejected by the image forming apparatus 1.

The controller 10 includes a central processing unit (CPU) and various memory devices and performs controls on the aforementioned units and performs arithmetic processing of various kinds in accordance with a program.

The operation panel 20 includes a touch panel, a numeric keypad, a start button, a stop button, and the like and is used for displaying various pieces of information and for inputting various instructions. The image reader 30 reads the image of a document and generates image data.

The image former 40 forms images based on various data on sheets of paper 100 by using an electrophotographic process. An intermediate transfer belt 41 is disposed in a central part of the image former 40. The intermediate transfer belt 41 is driven to rotate in the direction indicated by the arrow A, and the toner images formed on the surfaces of photosensitive drums (not shown) are transferred onto the intermediate transfer belt 41 in the primary transfer process. The toner images transferred to the intermediate transfer belt 41 in the primary transfer process are transferred to the sheets of paper 100 in the secondary transfer process.

Along the intermediate transfer belt 41, four imaging units 42Y, 42M, 42C, 42K (hereinafter abbreviated to 42) for yellow (Y), magenta (M), cyan (C), black (K) are disposed in this order from top to bottom. Each imaging unit 42 has a photosensitive drum. Near each photosensitive drum are provided a charger to uniformly charge the surface of the photosensitive drum, an exposure device to form an electrostatic latent image on the uniformly charged surface of the photosensitive drum in accordance with image data, and a developer to develop the electrostatic latent image into a toner image.

Primary transfer rollers 43Y, 43M, 43C, 43K (hereinafter abbreviated to 43) are respectively disposed opposite to the photosensitive drums, with the intermediate transfer belt 41 running between each pair of contraposed rollers. The primary transfer rollers 43 transfer the toner images formed on the surfaces of the photosensitive drums on to the intermediate transfer belt 41 by electrostatic attraction in the primary transfer process. A secondary transfer roller 44 is disposed beneath the intermediate transfer belt 41. The secondary transfer roller 44 transfers the toner image formed on the intermediate transfer belt 41 to a conveyed sheet of paper 100 in the secondary transfer process. The secondary transfer is performed by applying a transfer voltage between the intermediate transfer belt 41 and the secondary transfer roller 44 to transfer the toner image formed on the intermediate transfer belt 41 onto the sheet of paper 100 by electrostatic attraction. Details of a secondary transfer unit in which the secondary transfer is performed will be provided later.

The fixer 50 applies heat and pressure to the toner image transferred onto the sheet of paper 100 to fix the toner image on the sheet of paper 100.

The paper feeder 60 includes a plurality of paper trays 61, 62 and feeds sheets of paper 100 stored in the paper trays 61, 62 one by one to the downstream conveyance path.

The paper conveyer 70 includes a plurality of conveyance rollers to convey sheets of paper 100 and conveys sheets of paper 100 between the image former 40, the fixer 50, and the paper feeder 60.

The image forming apparatus 1 may include components other than the components described above. The image forming apparatus 1 need not include one or more of the components described above.

Figure 2A:
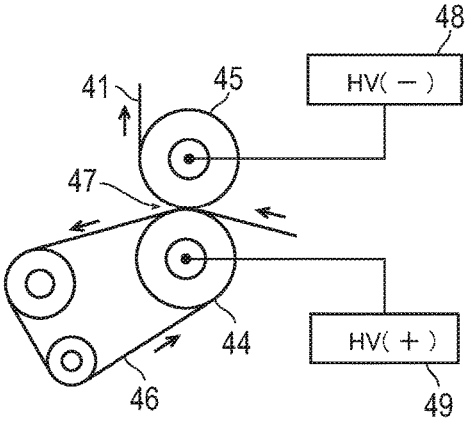
FIG. 2A is a diagram schematically illustrating the configuration of a secondary transfer unit.
Figure 2B:
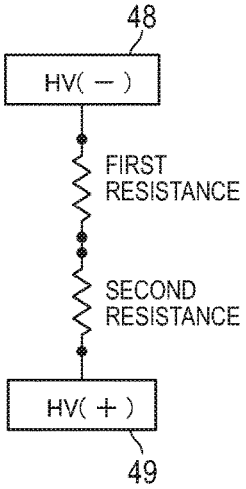
FIG. 2B is a diagram illustrating the electrical configuration of the secondary transfer unit.

With reference to FIGS. 2A and 2B, the secondary transfer unit will be described in detail. FIG. 2A is a diagram schematically illustrating the configuration of the secondary transfer unit. FIG. 2B is a diagram illustrating the electrical configuration of the secondary transfer unit.

As illustrated in FIG. 2A, a secondary transfer roller 44 is disposed beneath the intermediate transfer belt 41. A secondary transfer counter roller 45 is disposed inside the intermediate transfer belt 41, in the opposite position to the secondary transfer roller 44. The secondary transfer roller 44 is located inside a secondary transfer belt 46. The secondary transfer roller 44 contacts the secondary transfer counter roller 45 with the secondary transfer belt 46 and the intermediate transfer belt 41 running therebetween. The secondary transfer roller 44 is pressed against the secondary transfer counter roller 45 and a nipping part 47 is formed by the secondary transfer roller 44 and the secondary transfer counter roller 45 where the secondary transfer belt 46 contacts the intermediate transfer belt 41.

The secondary transfer counter roller 45 is connected with a first power source 48 having a negative polarity and the first power source 48 applies a negative voltage to the secondary transfer counter roller 45. The secondary transfer roller 44 is connected with a second power source 49 having a positive polarity and the second power source 49 applies a positive voltage to the secondary transfer roller 44. The potential difference between the output voltage of the first power source 48 and the output voltage of the second power source 49 provides transfer voltage. During the secondary transfer process, transfer voltage is applied between the secondary transfer roller 44 and the secondary transfer counter roller 45 and the toner image, which is negatively charged, is thereby transferred by electrostatic attraction onto the sheet of paper 100 that is passing through the nipping part 47.

As illustrated in FIG. 2B, the secondary transfer unit is constituted, electrically, by a first resistance including the intermediate transfer belt 41 and the secondary transfer counter roller 45 and a second resistance including the secondary transfer roller 44 and the secondary transfer belt 46, and the first resistance and the second resistance are connected in series between the first power source 48 and the second power source 49. In general, the resistance value of the first resistance is one to two times as large as the resistance value of the second resistance, and the resistance values of the first and second resistances may change in accordance with, among other factors, the environment. The intermediate transfer belt 41 and the secondary transfer counter roller 45 constitute an image holder that holds a toner image while the secondary transfer roller 44 and the secondary transfer belt 46 constitute a transferer that transfers the toner image to a sheet of paper 100. The intermediate transfer belt 41, the secondary transfer roller 44, the secondary transfer counter roller 45, and the secondary transfer belt 46 are conductive members conventionally known, details of which will not be described any further.

Figure 3:
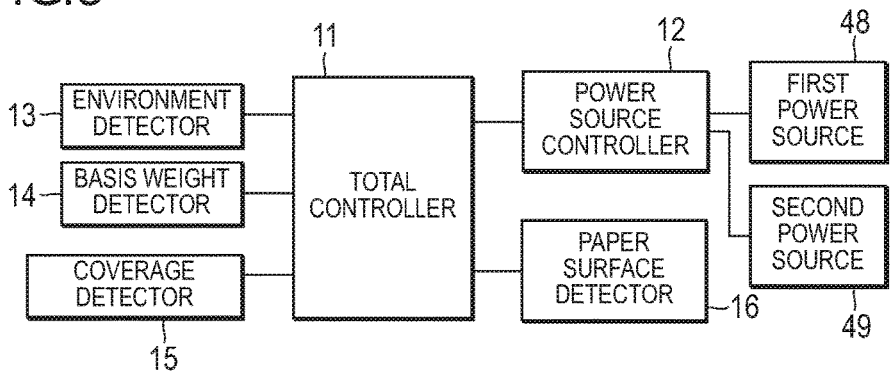
FIG. 3 is a functional block diagram for illustrating the transfer control function of the image forming apparatus.

With reference to FIG. 3, functions of the image forming apparatus 1 will be described. FIG. 3 is a functional block diagram for illustrating the transfer control function of the image forming apparatus 1.

The image forming apparatus 1 includes a total controller 11, a power source controller 12, an environment detector 13, a basis weight detector 14, a coverage detector 15, and a paper surface detector 16.

The total controller 11 controls the entire operations of the image forming apparatus 1. The power source controller 12 controls operations of the first and second power sources 48, 49. The environment detector 13 detects environment information (temperature, humidity) in the area in which the image forming apparatus 1 is installed. The basis weight detector 14 detects basis weight information of the sheet of paper 100 on which an image is formed. The coverage detector 15 detects coverage information, which is a ratio of the area of a toner image to the area of a sheet of paper 100. The paper surface detector 16 detects surface information indicating whether a toner image is to be transferred onto the first surface (front) or the second surface (back) of a sheet of paper 100. The CPU of the image forming apparatus 1 executes corresponding programs to cause the above-described units to perform their functions.

Figure 4A:
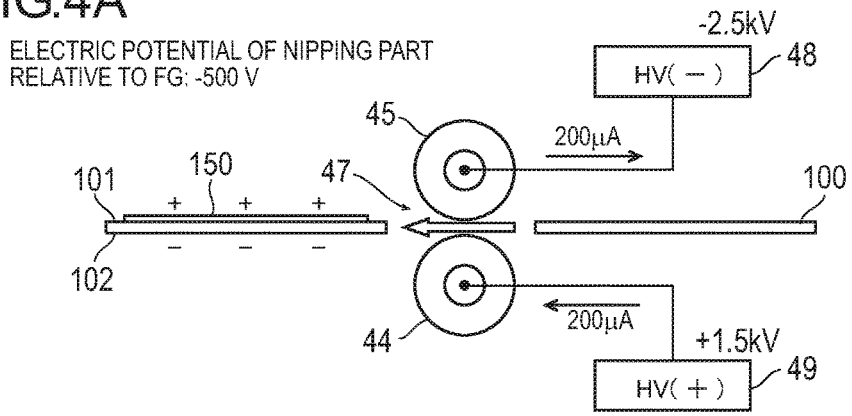
FIG. 4A is a diagram for illustrating a first transfer operation of the image forming apparatus.
Figure 4B:
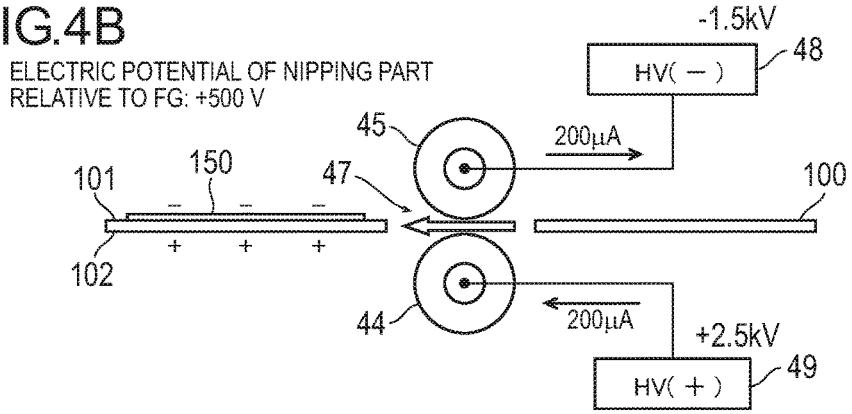
FIG. 4B is a diagram for illustrating a second transfer operation of the image forming apparatus.

With reference to FIGS. 4A and 4B, the secondary transfer operation of the image forming apparatus 1 will be described. In the present embodiment, a first transfer operation and a second transfer operation are switched over in such a manner that the polarity of the voltage at the nipping part 47 is reversed every time a sheet of paper 100 goes through the nipping part 47 between the secondary transfer roller 44 and the secondary transfer counter roller 45. The voltage at the nipping part 47 is the electric potential of the nipping part 47 relative to the frame ground (FG) electric potential and is determined by the output voltages of the first and second power sources 48, 49.

FIG. 4A is a diagram for illustrating a first transfer operation of the image forming apparatus 1 and FIG. 4B is a diagram for illustrating a second transfer operation of the image forming apparatus 1. It is assumed in FIGS. 4A and 4B that the first resistance, which includes the intermediate transfer belt 41 and the secondary transfer counter roller 45, and the second resistance, which includes the secondary transfer roller 44 and the secondary transfer belt 46, each have a resistance value of 10 MΩ and that the voltage required for adjusting the state of electric charge of a sheet of paper 100 is 500V.

As illustrated in FIG. 4A, in the first transfer operation, the power source controller 12 of the image forming apparatus 1 performs a constant current control on the first power source 48 to keep the output current value at 200 μA. The power source controller 12 also performs a constant voltage control on the second power source 49 to keep the output voltage value at +1.5 kV. As a result, a 200 μA current flows from the secondary transfer roller 44 to the secondary transfer counter roller 45, and due to voltage drop, the output voltage of the first power source 48 becomes −2.5 kV and the voltage at the nipping part 47 becomes −500 V. As a sheet of paper 100 conveyed from the paper feeder 60 goes through the nipping part 47, the toner image 150, which is negatively charged, is transferred from the intermediate transfer belt 41 onto the sheet of paper 100 and the state of electric charge of the sheet of paper 100 is adjusted. More specifically, as the sheet of paper 100 goes through the nipping part 47, which has a negative voltage (−500 V), the first surface 101 of the sheet of paper 100 becomes positively charged while the second surface 102 becomes negatively charged.

As illustrated in FIG. 4B, in the second transfer operation, the power source controller 12 of the image forming apparatus 1 performs a constant current control on the first power source 48 to keep the output current value at 200 μA. The power source controller 12 also performs a constant voltage control on the second power source 49 to keep the output voltage value at +2.5 kV. As a result, a 200 μA current flows from the secondary transfer roller 44 to the secondary transfer counter roller 45, and due to voltage drop, the output voltage of the first power source 48 becomes −1.5 kV and the voltage at the nipping part 47 becomes +500 V. As a sheet of paper 100 conveyed from the paper feeder 60 goes through the nipping part 47, the toner image 150, which is negatively charged, is transferred from the intermediate transfer belt 41 onto the sheet of paper 100 and the state of electric charge of the sheet of paper 100 is adjusted. More specifically, as the sheet of paper 100 goes through the nipping part 47, which has a positive voltage (+500 V), the first surface 101 of the sheet of paper 100 becomes negatively charged while the second surface 102 becomes positively charged.

The power source controller 12 switches between the first transfer operation and the second transfer operation every time a sheet of paper 100 is conveyed from the paper feeder 60 to the nipping part 47. The polarity of voltage at the nipping part 47 is thereby reversed for every sheet of paper 100, enabling the image forming apparatus 1 to alternately eject a sheet of paper 100 positively charged on its first surface 101 and a sheet of paper 100 negatively charged on its first surface 101. The sheets of paper 100 ejected from the image forming apparatus 1 are stacked in order in the stacker apparatus 2.

Note that in the above-described first and second transfer operations the voltage at the nipping part 47 may be changed in accordance with the basis weight of the paper 100 or the environment in which the image forming apparatus 1 is placed. Details will be described later of the operation for changing the voltage at the nipping part 47 in accordance with the basis weight of the paper 100 or the environment in which the image forming apparatus 1 is placed. The power source controller 12 controls the output voltages of the first and second power sources 48, 49 to keep the absolute values of the output voltages of the first and second power sources 48, 49 at equal to or less than a predetermined allowable value (for example, 6 kV).

Figure 5:
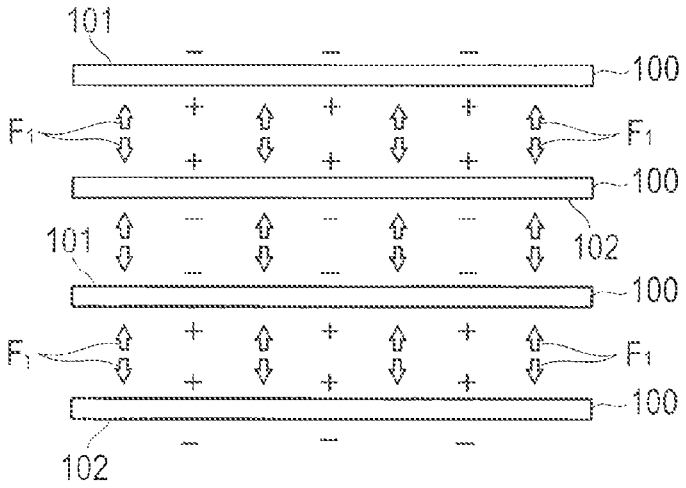
FIG. 5 is a diagram illustrating the state of electric charge of sheets of paper ejected from the image forming apparatus.
Figure 6:
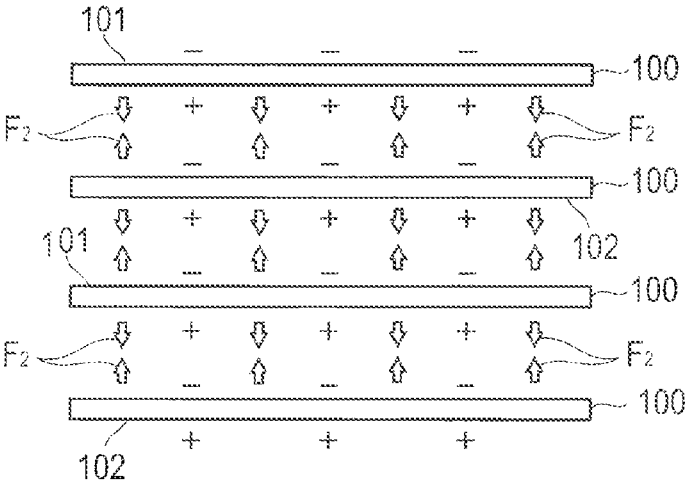
FIG.6 Prior Art
FIG. 6 is a diagram illustrating the state of electric charge of sheets of paper ejected from a conventional image forming apparatus.

With reference to FIGS. 5 and 6, advantageous effects of the image forming apparatus 1 will be described.

FIG. 5 is a diagram illustrating the state of electric charge of sheets of paper 100 ejected from the image forming apparatus 1 according to the present embodiment and stacked in the stacker apparatus 2. In the stacker apparatus 2, as illustrated in FIG. 5, the surfaces of the sheets of paper 100 confronting each other in the direction of stacking have the same polarity. More specifically, when the first surface 101 of a sheet of paper 100 is positively charged, the second surface 102 of the sheet of paper 100 stacked above and adjacent to the aforementioned sheet of paper 100 is also positively charged. Similarly, when the first surface 101 of a sheet of paper 100 is negatively charged, the second surface 102 of the sheet of paper 100 stacked above and adjacent to the aforementioned sheet of paper 100 is also negatively charged.

According to this configuration, repelling electrostatic force $F_1$ applies to the sheets of paper 100 stacked adjacent to each other, and the sheets of paper 100 separate themselves from each other.

FIG. 6 is a diagram illustrating the state of electric charge of sheets of paper ejected from a conventional image forming apparatus as a comparative example. A sheet of paper 100 on which an image is formed by a conventional image forming apparatus has, for example, the first surface 101 negatively charged and the second surface 102 positively charged. As illustrated in FIG. 6, therefore, when the sheets of paper 100 are stacked in the stacker apparatus, the confronting surfaces of the sheets of paper 100 stacked adjacent to each other have opposite polarities. In the case of a conventional image forming apparatus, therefore, attracting electrostatic force $F_2$ applies to the sheets of paper 100, and the sheets of paper 100 cling to each other.

As described above, the image forming apparatus 1 according to the present embodiment reverses polarity of the voltage at the nipping part 47 between the secondary transfer roller 44 and the secondary transfer counter roller 45 for every sheet of paper 100 while maintaining the potential difference between the first power source 48 and the second power source 49 and the polarities of the first and second power sources 48, 49. This configuration allows toner images to be transferred from the intermediate transfer belt 41 to sheets of paper 100 while adjusting the state of electric charge of the sheets of paper 100 ejected from the image forming apparatus 1 and preventing the sheets of paper 100 from clinging to each other.

With reference to FIGS. 7A and 7B, further advantageous effects of the image forming apparatus 1 will be described. FIG. 7A is a diagram illustrating the secondary transfer unit of the image forming apparatus 1 according to the present embodiment. FIG. 7B is a diagram illustrating the secondary transfer unit of a conventional image forming apparatus as a comparative example. In the following, a case with a transfer voltage of 10.0 kV will be described as an example.

As illustrated in FIG. 7B, a conventional image forming apparatus, for example, applies a voltage of −10 kV solely to the secondary transfer counter roller with the secondary transfer roller electrically grounded. To employ a higher transfer voltage in a conventional image forming apparatus, therefore, it would be necessary to incorporate a high voltage transformer into the power source connected to the secondary transfer counter roller and to use high voltage wiring, resulting in an increase in the size of the power source and in cost increase. Besides, in the conventional image forming apparatus, other requirements would arise such as ensuring insulation distance (clearance distance and creepage distance) and wiring arrangement for avoiding interference with the signal wires, which would increase constraints on designing.

In contrast, as illustrated in FIG. 7A, the image forming apparatus 1 according to the present embodiment controls the output voltages of the first and second power sources 48, 49 respectively at −5.0 kV and +5.0 kV relative to the frame ground (FG) electric potential, thereby providing a transfer voltage of 10.0 kV. In other words, the sum of the absolute values of the output voltages of the first and second power sources 48, 49 is equal to the transfer voltage. Hence, the image forming apparatus 1 according to the present embodiment can keep the output voltages of the first and second power sources 48, 49 low even with a higher transfer voltage, with no need for incorporating a high voltage transformer into the first and second power sources 48, 49 or for using high voltage wiring, preventing increase in the size of the power source and cost increase. Besides, the image forming apparatus 1 according to the present embodiment eliminates the need for ensuring insulation distance (clearance distance and creepage distance) and wiring arrangement for avoiding interference with the signal wires, which reduces constraints on designing.

As described above, according to the image forming apparatus 1 according to the present embodiment, the transfer voltage is provided by the potential difference between the two power sources 48, 49 having opposite polarities, which allows the transfer voltage to be increased without raising the output voltages of the first and second power sources 48, 49. Therefore, the transfer voltage in the secondary transfer process can be increased while reducing constraints on designing and restraining increase in the size of the power source and cost increase.

Modified Embodiment

Figure 9:
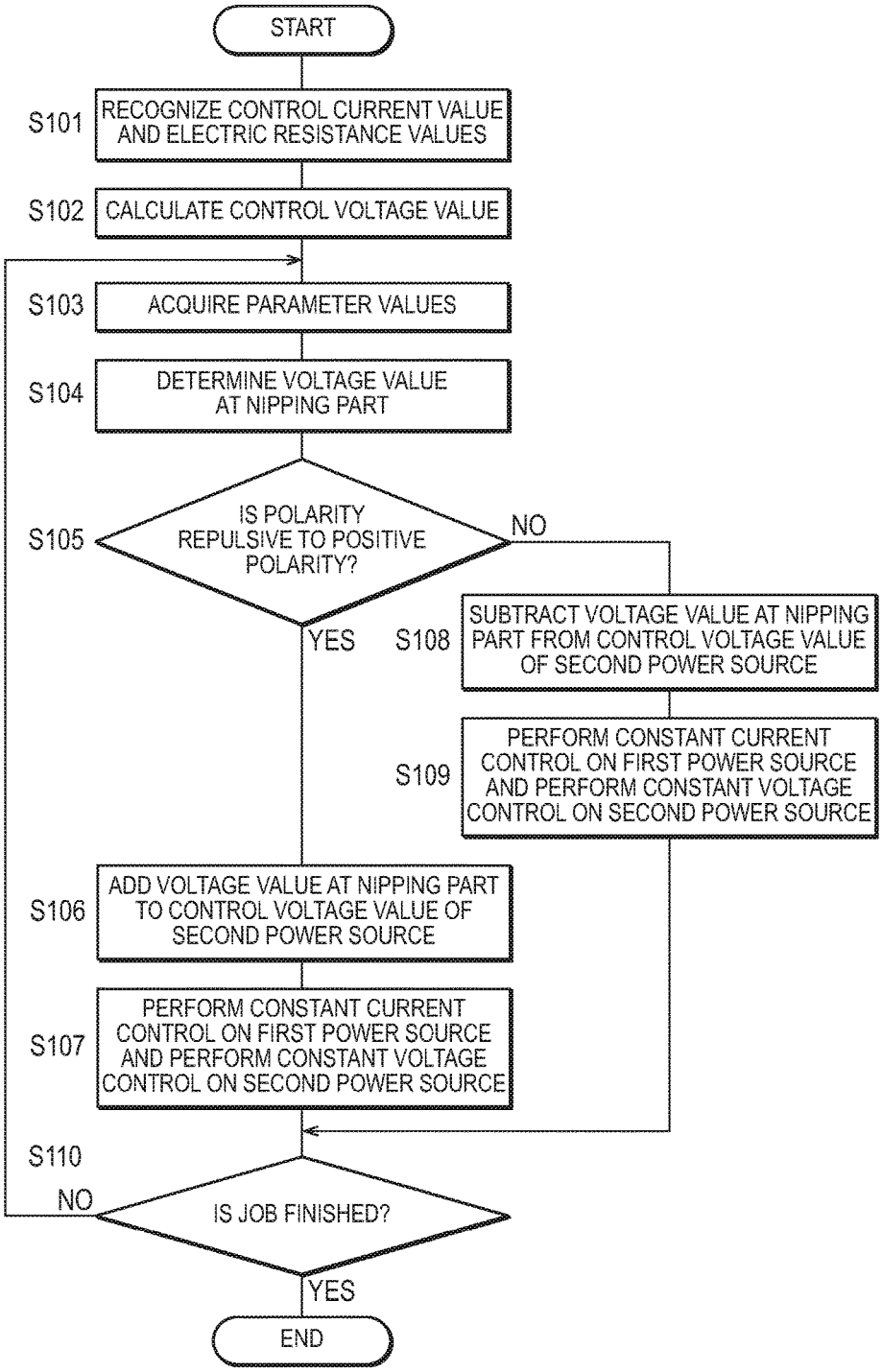
FIG. 9 is a flow chart illustrating the steps of a secondary transfer process according to a modified embodiment.

With reference to FIGS. 8 and 9, a modified embodiment of the secondary transfer process will be described below. In this modified embodiment, the voltage at the nipping part 47 between the secondary transfer roller 44 and the secondary transfer counter roller 45 is changed in accordance with the basis weight of the paper 100 and the environment in which the image forming apparatus 1 is placed.

FIG. 8 is a diagram illustrating an example of a voltage value reference table 200 stored in the image forming apparatus 1. As illustrated in FIG. 8, in the present modified embodiment, the voltage (in absolute value) at the nipping part 47 is associated with basis weight information, surface information, coverage information, and environment information. In FIG. 8, the coverage information is represented at two levels, i.e., a 200% coverage and a 0% coverage, and the environment information is represented at three levels, i.e., high temperature and high humidity HH, normal temperature and normal humidity NN, and low temperature and low humidity LL. The voltage values on the voltage value reference table 200 are obtained by, for example, an experiment.

FIG. 9 is a flow chart illustrating the steps of a secondary transfer process executed by the image forming apparatus 1. In the following, the resistance values of the first resistance, which includes the intermediate transfer belt 41 and the secondary transfer counter roller 45, and the second resistance, which includes the secondary transfer roller 44 and the secondary transfer belt 46, are both assumed to be 10 MΩ and the required control current value to be 200 μA.

First, the image forming apparatus 1 recognizes the control current value and the electric resistance values (Step S101). More specifically, the power source controller 12 recognizes that the electric resistance values of the first and second resistances are both 10 MΩ and that the required control current value is 200 μA.

Next, the image forming apparatus 1 calculates the control voltage value (Step S102). More specifically, based on the control current value of 200 μA and the electric resistance values of 10 MΩ, the power source controller 12 calculates the control voltage values for the first and second power sources 48, 49, which are −2.0 kV and +2.0 kV, respectively.

Next, the image forming apparatus 1 acquires parameter values (Step S103). More specifically, the power source controller 12 analyzes the print job and acquires the basis weight information of the sheet of paper 100 on which an image is formed, the coverage information of the image, and the surface information of the sheet of paper 100. The power source controller 12 also acquires the environment information from the temperature and humidity sensors (not shown) provided for the image forming apparatus 1.

Next, the image forming apparatus 1 determines the voltage value at the nipping part 47 (Step S104). More specifically, the power source controller 12 determines the voltage value at the nipping part 47 by referring to the voltage value reference table 200. For example, when the basis weight is 128, the coverage is 200%, the surface is the first surface, and the environment is NN, a voltage value of 660 V is obtained by referring to the voltage value reference table 200. When the coverage is neither 0% nor 200%, the power source controller 12 calculates a voltage value corresponding to the coverage value by referring to the voltage value reference table 200. More specifically, when the coverage is 100%, the power source controller 12 calculates, for example, an average of the voltage value corresponding to the 0% coverage and the voltage value corresponding to the 200% coverage to obtain the voltage value at the nipping part 47.

Next, the image forming apparatus 1 determines whether or not the polarity of the immediately preceding sheet of paper 100 is repulsive to a positive polarity (Step S105). More specifically, the power source controller 12 determines whether or not the polarity of the first surface 101 of the immediately preceding sheet of paper 100 that just went through the nipping part 47 is repulsive to a positive polarity.

When it is determined that the polarity of the immediately preceding sheet of paper 100 is repulsive to a positive polarity (YES in Step S105), the image forming apparatus 1 calculates the output voltage value of the second power source 49 by adding the voltage value at the nipping part 47 to the control voltage value of the second power source 49 (Step S106). More specifically, the power source controller 12 adds 660 V to +2.0 kV to obtain +2660 V as the output voltage value of the second power source 49.

The image forming apparatus 1 then performs a constant current control on the first power source 48 at the control current value and performs a constant voltage control on the second power source 49 at the output voltage value (Step S107). More specifically, the power source controller 12 performs constant current control on the first power source 48 at 200 μA and performs a constant voltage control on the second power source 49 at +2660 V. As a result, the output voltage of the first power source 48 becomes −1340 V and the electric potential at the nipping part 47 becomes +660 V. Thus, the second surface 102 of the sheet of paper 100 that goes through the nipping part 47 is positively charged to repel the first surface 101 of the immediately preceding sheet of paper 100.

On the other hand, when it is determined in the process in Step S105 that the polarity of the immediately preceding sheet of paper 100 is not repulsive to a positive polarity (NO in Step S105), the image forming apparatus 1 calculates the output voltage value of the second power source 49 by subtracting the voltage value at the nipping part 47 from the control voltage value of the second power source 49 (Step S108). More specifically, the power source controller 12 subtracts 660 V from +2.0 kV to obtain +1340 V as the output voltage value of the second power source 49.

The image forming apparatus 1 then performs a constant current control on the first power source 48 at the control current value and performs a constant voltage control on the second power source 49 at the output voltage value (Step S109). More specifically, the power source controller 12 performs a constant current control on the first power source 48 at 200 μA and performs a constant voltage control on the second power source 49 at +1340 V. As a result, the output voltage of the first power source 48 becomes −2660 V and the electric potential at the nipping part 47 becomes −660 V. Thus, the second surface 102 of the sheet of paper 100 that goes through the nipping part 47 is negatively charged to repel the first surface 101 of the immediately preceding sheet of paper 100.

Next, the image forming apparatus 1 determines whether or not the job is finished (Step S110). When it is determined that the job is not finished (No in Step S110), the image forming apparatus 1 returns to the process in Step S103. The image forming apparatus 1 then repeats the process from Step S103 until the job is finished. On the other hand, when it is determined that the job is finished (YES in Step S110), the image forming apparatus 1 terminates the process.

As described above, according to the process illustrated in the flow chart in FIG. 9, the voltage value at the nipping part 47 is changed in accordance with the basis weight of the paper 100 and the environment. Such a configuration optimizes the voltage value at the nipping part 47 and consumes less electric power compared with a configuration in which the voltage value is kept constant.

In the above-described modified embodiment, four parameter values, i.e., basis weight information, coverage information, surface information, and environment information are used to determine the voltage value at the nipping part 47. The voltage value at the nipping part 47, however, may be determined using three or fewer of the four parameter values. In general, the greater the basis weight of the paper 100 is, the higher the voltage value at the nipping part 47 tends to be, and the greater the coverage is, the higher the voltage value at the nipping part 47 tends to be. The voltage value at the nipping part 47 tends to be higher when the toner image is transferred onto the second surface of a sheet of paper 100 than when it is transferred onto the first surface. The higher the humidity is, the lower the voltage value at the nipping part 47 tends to be.

The present invention is not limited to the above-described embodiments but may be modified in various ways within the scope of the invention as defined in the appended claims.

For example, a constant current control is performed on the first power source 48 and a constant voltage control is performed on the second power source 49 in the above-described embodiment. The first and second power sources 48, 49, however, may be controlled in other ways and a constant voltage control may be performed on the first power source 48 and a constant current control may be performed on the second power source 49.

Further, the secondary transfer roller 44 contacts the intermediate transfer belt 41 with the secondary transfer belt 46 therebetween in the above-described embodiment. The secondary transfer roller 44, however, may directly contact the intermediate transfer belt 41 without the secondary transfer belt 46.

Further, the voltage value at the nipping part 47 between the secondary transfer roller 44 and the secondary transfer counter roller 45 is changed in accordance with the basis weight of the paper 100 or the like in the above-described embodiment. The voltage value at the nipping part 47, however, may be changed in accordance with the type of the paper 100 (glossy paper/normal paper). In this case, for example, the voltage value is set at a higher value when glossy paper is used than when normal paper is used.

The units and methods for executing the various processes in the image forming apparatus according to the above-described embodiment may be implemented by a dedicated hardware circuit or a programmed computer. The program may be provided by way of a non-transitory computer-readable recording medium such as compact disc read only memory (CD-ROM) or provided online through a network such as the Internet. In such a case, the program stored in the non-transitory computer-readable recording medium is usually transferred to a storage such as a hard disk and stored therein. The program may be provided as a separate piece of application software or may be treated as executing one of the functions of the image forming apparatus and incorporated into the software for the apparatus.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image holder that holds a toner image;

a transferer that is disposed opposite to the image holder so as to be in contact with the image holder and transfers the toner image from the image holder onto a recording sheet that is going through a contact part where the transferor contacts the image holder, by applying a transfer voltage between the transferer and the image holder;

a first power source that applies a voltage of a first polarity to the image holder;

a second power source that applies a voltage of a second polarity, which is reverse to the first polarity, to the transferer; and a power source controller that changes output voltages of the first and second power sources for every recording sheet while maintaining a potential difference between the first power source and the second power source and the polarities of the first and second power sources in such a manner that the polarity of electric potential at the contact part relative to a frame ground potential becomes reversed every time a recording sheet goes through the contact part between the image holder and the transferer.

2. The image forming apparatus as claimed in claim 1, wherein the power source controller changes the output voltages of the first and second power sources while keeping absolute values of the output voltages of the first and second power sources at equal to or less than an allowable value.

3. The image forming apparatus as claimed in claim 1, wherein an absolute value of the electric potential at the contact part is changed in accordance with at least one of a basis weight of the recording sheet, a type of the recording sheet, a coverage of the toner image transferred onto the recording sheet, a surface of the recording sheet onto which the toner image is transferred, and an environment in which the image forming apparatus is placed.

4. An image forming method comprising:

conveying a recording sheet in a conveyance path;

applying a transfer voltage between an image holder that holds a toner image and a transferer that is disposed opposite to the image holder so as to be in contact with the image holder by applying a voltage of a first polarity supplied by a first power source to the image holder and applying a voltage of a second polarity supplied by a second power source to the transferor, the second polarity being reverse to the first polarity, to transfer the toner image from the image holder onto the recording sheet that is going through a contact part where the transferer contacts the image holder; and changing output voltages of the first and second power sources for every recording sheet while maintaining a potential difference between the first power source and the second power source and the polarities of the first and second power sources in such a manner that the polarity of electric potential at the contact part relative to a frame ground potential becomes reversed every time a recording sheet goes through the contact part between the image holder and the transferer.

5. The image forming method as claimed in claim 4, wherein the output voltages of the first and second power sources are changed while absolute values of the output voltages of the first and second power sources are kept at equal to or less than an allowable value.

6. The image forming method as claimed in claim 4, wherein an absolute value of the electric potential at the contact part is changed in accordance with at least one of a basis weight of the recording sheet, a type of the recording sheet, a coverage of the toner image transferred onto the recording sheet, a surface of the recording sheet onto which the toner image is transferred, and an environment.

* * * * *